United States Patent [19]

Steinberg et al.

[11] 3,930,639

[45] Jan. 6, 1976

[54] PUMPABLE ROCKBOLT METHOD

[75] Inventors: Meyer Steinberg, Huntington Station; Bernard Manowitz, Brightwaters; Charles H. Waide, Center Moriches, all of N.Y.

[73] Assignee: The United States of America as represented by the United States Energy Research and Development Administration, Washington, D.C.

[22] Filed: Sept. 27, 1974

[21] Appl. No.: 509,998

Related U.S. Application Data

[62] Division of Ser. No. 312,393, Dec. 5, 1972, Pat. No. 3,861,755.

[52] U.S. Cl. ..... 259/4; 61/45 B

[51] Int. Cl.[2] ..... B01F 15/02

[58] Field of Search ..... 259/151, 4, 153, 148, 146, 259/147; 61/45 R, 45 B, 35

[56] References Cited

UNITED STATES PATENTS

| | | | |
|---|---|---|---|
| 2,930,199 | 3/1960 | Jarund | 61/45 B |
| 3,108,442 | 10/1963 | Miller | 61/35 |
| 3,332,244 | 7/1967 | McLean | 61/35 |
| 3,541,797 | 11/1970 | Stewart | 61/45 B |
| 3,790,030 | 2/1974 | Ives | 259/4 |

*Primary Examiner*—Robert W. Jenkins

*Attorney, Agent, or Firm*—Dean E. Carlson; Leonard Belkin

[57] ABSTRACT

Method and apparatus for producing rockbolts in the roof of a subterranean cavity in which two components of an ambient temperature curable resin system are premixed and then inserted into a bore hole. The mixture is permitted to polymerize in situ and then the hardened material is cut off at the entrance to the hole leaving a hardened portion for insertion into the next hole as a precursor. In a preferred embodiment a flexible glass roving is employed to reinforce the material in the hole and a metal tube inserted to support the roving while it is fed into the hole and also to provide venting. The roving and tube is then cut off and left in the hole.

4 Claims, 1 Drawing Figure

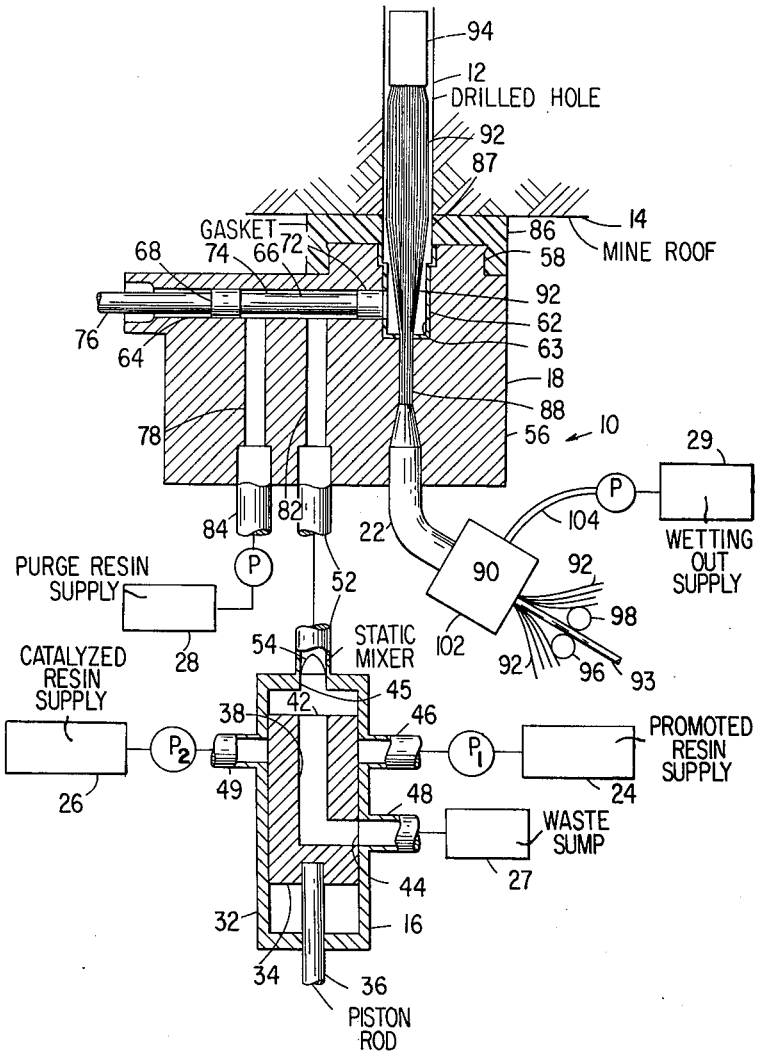
94
12
DRILLED HOLE
92
87
14
MINE ROOF
86
58
GASKET
68
74
66
72
92
62
63
76
64
18
88
78
56
10
29
P
104
WETTING OUT SUPPLY
84
82
22
PURGE RESIN SUPPLY
P
52
90
92
98
54
STATIC MIXER
102
92
96
93
CATALYZED RESIN SUPPLY
28
45
38
42
46
PROMOTED RESIN SUPPLY
P2
P1
26
49
48
24
WASTE SUMP
27
44
32
16
34
36
PISTON ROD

PUMPABLE ROCKBOLT METHOD

This is a division of application Ser. No. 312,393, filed Dec. 5, 1972 now U.S. Pat. No. 3,861,755.

BACKGROUND OF THE INVENTION

The invention described herein was made in the course of, or under a contract with the U.S. Atomic Energy Commission.

Rockbolts have long been employed to strengthen or stabilize coal or other mine roof structures by tying together laminated or fissured rock strata. In the past, a rockbolt typically would consist of a steel rod of sufficient length to extend from the roof-line up into a region of relatively strong rock, perhaps 3 to 10 feet into the roof. An expansion wedge anchor at the upper end of the bolt is secured in the surrounding rock by rotating the bolt at the roof-line using a torque wrench to set the anchor and tension the bolt. A steel plate washer between the bolt head and the rock roof may be employed to spread the load to the rock.

In order to improve the contact between the bolts and the rock in the roof of the mine, resin anchors have been employed which in a typical arrangement involves the insertion of resin packages into the holes which are then broken by insertion of the bolts and mixed by rotation of the bolts providing a rapid setting polymer anchor for the bolt. Fully-grouted bolts also have been used and such bolts consist of deformed bars, with or without a head, which would then be cemented into a hole using concrete or polymeric materials as grouting materials.

However, it has been found that in the application of the resin anchors as described in U.S. Pat. Nos. 3,302,410, 3,324,662 and 3,091,935, sufficient technical difficulties are involved in preparing such rockbolts that they are time consuming to prepare, expensive, and sometimes do not provide adequate physical characteristics to provide the support desired in the roof of a mine.

SUMMARY OF THE INVENTION

In accordance with the principles of this invention a pumpable rockbolt has been developed which can be employed with sufficient efficiency, effectiveness and facility that it can be utilized in the place of previous methods which cannot provide all the benefits of this invention.

In a preferred embodiment of this invention there is provided a method of reinforcing the roof of a subterranean cavity comprising the drilling of spaced holes upwardly into the roof, injecting and filling each of the holes with a polymerizable mixture, some of the mixture extending out of the hole being filled and after a period of time sufficient to permit the mixture to harden in situ removing a plug of the hardened portion of the mixture extending out of the hole, and subsequently inserting the hardened portion into the next hole to be filled as a precursor for the mixture inserted into that hole.

In another embodiment, apparatus is provided for producing a pumpable rockbolt in a bore hole upwardly extending into the roof of a mine in which there are provided first and second supply sources of the two components of an ambient temperature curable polymerizable resin system, a mixing device for receiving the first and second components for forming an intimate mixture thereof, a bolting head assembly for receiving the mixture from the mixing means having an extended exit conduit for communicating directly with the inlet of the bore hole for delivering the mixture into the hole, the bolting head assembly having a gasket surrounding the exit conduit for providing a resilient substantially leak proof seal between the exit conduit and the rock face surrounding the hole, said gasket being of material substantially not adhered to by said resin system when the latter is cured in contact therewith, and means for purging the mixture from the bolting head assembly. This arrangement results in an efficient, effective and economical means of delivering the polymerizable bolt materials to the bolt holes. An additional advantage of this apparatus is that it permits the use of flexible roving material and metal tubing incorporated into the apparatus for reinforcing the polymer in the holes and also to provide venting during filling of the holes.

Another feature of this invention with respect to the method involved is the use of high viscosity materials to prevent the spreading or the distribution of the mixture throughout the cracks surrounding the holes into which the mixture is inserted. For this purpose, also, the mixture in accordance with the principles of this invention is inserted at barely sufficient pressure to flow the mixture into the holes. This avoids the use of high pressures which would tend to force the fluid into cracks and fissures and cause further damage to the structure of the roof which in some circumstances should be avoided.

It is thus a principal object of this invention to provide for the in situ preparation of rockbolts in the roofs of subterranean voids with greater effectiveness, efficiency and economy than has been heretofore attained.

Other objects and advantages of this invention will hereinafter become evident from the following description of preferred embodiments of this invention.

BRIEF DESCRIPTION OF THE DRAWINGS

The FIGURE illustrates in partial schematic form a preferred embodiment of this invention.

DESCRIPTION OF THE PREFERRED EMBODIMENTS

Referring to the FIGURE, there is illustrated an apparatus 10 embodying the principles of this invention for use in filling hole 12, which may have been drilled, in mine roof 14. Apparatus 10 consists of a slide valve assembly 16, a bolting head assembly 18, a feed pipe 22 for roving and other materials as will be described further below, a supply 24 of promoted resin, a supply 26 of catalyzed resin, a waste sump 27, a supply 28 of purge resin, and a supply 29 of wetting fluid.

Slide valve assembly 16 consists of a cylinder 32 containing a slidable piston 34 operated by a piston rod 36. Piston 34 is provided with a passageway 38 which at one end is axially located and at the other end opens to the side wall of cylinder 32. The axial opening is designated 42 and the side opening is designated as 44. Cylinder 32 is provided with an outlet opening 45 and conduits 46, 48 and 49, which are connected, respectively, to the promoted resin supply 24, waste sump 27, and catalyzed resin supply 26, and a conduit 52. It will be seen that the position of piston 34 determines whether or not side opening 44 either communicates with sump 27 (as illustrated) or resin supplies 24 and 26 are open to outlet opening 45, the latter situation occurring when piston 34 is retracted downwardly, blocking off conduit 48. The upper end of cylinder 32 communicates to and is connected by opening 45 into conduit 52 to bolting head assembly 18 for reasons to be described further below. In conduit 52 is provided a helical static mixer 54 which provides for thorough mixing of the two components of the resin system as it flows upwardly to bolting head assembly 18. Pumps $P_1$ and $P_2$ are provided which deliver, when actuated, the resins from supplies 24 and 26, respectively, as will be described further below. Pumps $P_1$ and $P_2$ may if desired be part of a proportioning arrangement for delivering the resins from supplies 24 and 26 in any desired proportion.

Bolting head assembly 18 consists of a solid body 56 having an exit cylindrical extension 58 with a central countersunk well 62 which has a coating 63 of a suitable material, such as Teflon, to which the resins when polymerized will not adhere. Side access to well 62 is provided by a passageway 64 in which there is a slidable piston assembly 66 consisting of a pair of pistons 68 and 72 connected by a shaft 74. Assembly 66 is controlled slidably by a piston rod 76 extending out the side of bolting head assembly 18. Communication to passageway 64 is obtained by a pair of passageways 78 and 82 spaced as illustrated which are communicated to by a conduit 84 and the previously identified conduit 52, respectively. Conduit 84 is connected to purge resin supply 28 through a pump $P_3$.

Extension 58 is provided with a gasket or covering element 86 with an opening 87 aligned with well 62. Element 86 is made from a resilient material to reduce the effect of any impact and provide sealing between assembly 18 and roof 14 and to which the resins upon polymerization will not adhere. A suitable material is Teflon. When bolting head assembly 18 is positioned as illustrated it abuts against the surface of mine roof 14. Central opening 87 through gasket element 86 is aligned with drilled roof hole 12 and well 62 in bolting head assembly 18. Thus, it is seen that when assembly 18 is positioned in the manner illustrated, there is communication between well 62 and hole 12. It will also be seen that piston rod 76 may be manipulated to uncover either only passageway 82 for supplying mixture to well 62 and into hole 12 or, in the position illustrated uncovering passageways 78 and 82 for purging remaining mixture in bolting head assembly 18 by permitting the purging fluid to enter into bolting head assembly 18 and purge out through passageway 82 all of the mixture remaining within passageway 64.

To supply well 62 in body 56 with roving and similar material to be described below there is provided a passageway 88 in body 56 to which is connected feedpipe 22 extending from a wetting box 90 which is supplied with wetting fluid from supply 29 by way of pump $P_3$. Roving 92 and a hollow vent tube 93 pass through wetting box 90 into feedpipe 22 and passageway 88 and then into well 62 and hole 12 terminating in a plug 94. A pair of rollers 96 and 98 suitably actuated push vent tube 93 into hole 12 as illustrated, dragging or pulling roving 92 therewith. Roving 92 preferably consists of continuous filament glass or similar long fibers or strands of strong nonflammable material which would be supplied from rolls not shown. Tube 93 is sufficiently flexible to come from a roll and sufficiently rigid to push into hole 12 in the manner shown. Aluminum tubing for this purpose has been found to be adequate to accomplish this. As will be seen later, plug 94 consists of a polymerized section which extended into well 62 from a previous roof hole and which was cut or sawed off at the roof line, forming a precursor for the monomer, roving, and tubing being supplied to the illustrated hole 12. Tube 93, being hollow, functions also as a means of venting entrapped air or gases in hole 12 as the latter is being filled from the roof line.

The monomer selected for use in accordance with this invention should be capable of being polymerized by the catalyst and promoter under ambient conditions as there is no provision for the application of heat to initiate the process. In a typical mine roof, ambient temperature is about 60°F. Furthermore, as the polymerization reaction is exothermic and the space in which the reaction occurs is confined and heat transfer away from the hole through the rock strata present is poor, it is also desirable to select a polymerizable composition which has a flash point of at least 100° F for reasons of safety. Furthermore, the polymerizable composition must contain sufficient filler material to increase the viscosity to the point where it will not flow transversely out of hole 12 into and along crevices, cracks, faults, and the like. A minimum viscosity for this purpose is 1000 centipoise, and a preferred range is 1000–50,000 centipoise. Other preferred characteristics of the composition employed include that it will expand during setting in order to provide adequate bonding with the bordering rock strata, and setting time, as least to the point where assembly 18 can be removed, should be fairly rapid, such as within about ten minutes. Some or all of these characteristics can be obtained by the use of additives. The wetting mixture whose purpose is to insure thorough impregnation of the roving, can consist of the same monomer without the presence of additives other than catalyst, while the purging fluid can be any liquid which will dissolve and wash away the monomer.

In the operation of the apparatus illustrated, roof 14 is first prepared by having one or more holes 12 drilled therein of sufficient length to accomplish the purposes of the roof bolts prepared by this invention. A typical depth would be about six feet. Then bolting head assembly 18 is moved up into contact with the surface of roof 14 so that the opening in gasket 86 is aligned with entry into hole 12. As will be seen from the drawing, the portion of roving 92 left over from a previous hole which had been impregnated terminates in a solid cap 94 which was saturated with the mixture and hardened and cut off from the piece extending out of the previous hole. As already noted, plug 94 comes from within well 62 where the polymer does not adhere to the walls thereof because of coating 62. Thus, when assembly 18 is aligned with hole 12, solid plug 94 is ready for entry into opening 12. Rollers 96 and 98 may then be actuated to push tube 93 with plug 94 into hole 12, pulling roving 92, while simultaneously piston 34 in slide valve assembly 32 is lowered to a sufficient point where both the catalyzed resin supply 26 and the promoted resin supply 24 are exposed by the upper edge of piston 34 to conduit 52. Pumps $P_1$ and $P_2$ are actuated to pump these fluids into this conduit where they are mixed by mixer 54 and pass up into assembly 18. At the same time, piston rod 76 is manipulated so as to expose passageway 82 to well 62 (blocking passageway 78) so that the mixture coming from conduit 52 enters into well 62 and passes up through gasket 86 into hole 12. Pump $P_4$ is activated to maintain wetting box 90 full of the wetting fluid. Pumping of the mixture continues until plug 94 reaches the desired height, as measured by the amount of tubing or roving used, or until hole 12 is filled, as indicated by cessation of flow.

The resins are supplied at only sufficient pressure to overcome the static head in hole 12 in order to avoid the distribution of the fluid into crevices and cracks which might at high pressure result in further damage to the mine roof 14. Pumps $P_1$ and $P_2$ supply the resins in predetermined proportions, typically equal amounts of each. Wetting fluid supplied to box 90 insures that the roving will not trap any air and will be saturated with composition supplied to well 62. When supply of hole 12 is completed, pumps $P_1$, $P_2$, and $P_4$ are deenergized, and piston rods 36 and 76 are moved to their purging positions as illustrated in the FIGURE. Pump $P_3$ is energized to clear the lines of any mixture which can polymerize. At the same time, assembly 18 is held in place until the mixture extending into hole 12 jells enough not to flow out when assembly 18 is removed. When assembly 18 is lowered a short distance (some roving 92 and some length of vent tube 93 are pulled through when this occurs) the plug extending out of hole 12 is cut by a suitable cutting tool. The plug extending out of well 62 attached to the roving and tubing then becomes the precursor for the next hole.

It should be noted at this point that the viscosities of the resins which are utilized in this invention are sufficiently high at the temperature of use, i.e., in the range of 1000 to 50000 centipoise, to enhance the nonpenetration characteristics of the fluid into the cracks and crevices surrounding hole 12. In addition, so that only a minimum length of time is required before the mixture is set enough so that bolting head assembly 18 can be removed and aligned up with the next hole to be filled, it has been found that at a temperature of 50–60°F within about ten minutes or less the mixtures and materials described herein are sufficiently solid such that bolting head assembly 18 can be removed.

It should be understood that although roving 92 with venting tube 93 are described and illustrated in connection with this invention that if the conditions of the mine roof 14 warrant it, it may be desirable and possible to employ the resins alone or with only roving 92 or only tubing 93. In addition, the mixture may contain a variety of materials, such as certain fillers and additives to decrease shrinkage during curing, decrease the exotherm which occurs during curing, adjust the viscosity of the resin, improve the modulus of elasticity of the polymerized product, improve the bonding of the resin to the rock surfaces, reduce the flammability, and reduce the cost. Among the filler materials used and found to be useful for some of these purposes are clay, fumed silica, milled glass fiber, asbestos, and ground shale. Other fillers are available and, of course, could be used.

When glass fiber is employed for roving 92 it may be treated with materials on the surface making it compatible with polyester resins as is understood in the art. These surface treatments make the bond between the glass and the polyester stronger. A bonding agent which serves this purpose and can be added to the resin phase is gamma-methacryloxypropyltrimethoxy silane.

The continuous filament glass roving 92 described herein has been found to provide excellent reinforcement for the pumpable bolt described. Roving 92 is pumped or driven from a spool into the drilled hole with the polyester resins. This material provides a significant increase in the strength of the bolt over bolts cast from short fiber reinforced polyester resins, and further, the tensile and modulus of elasticity values of a pumpable bolt can be varied over a wide range depending on the type and quantity of reinforcement used.

It should also be noted in connection with the apparatus illustrated and described hereinabove that movement of piston rods 36 and 76 may be accomplished manually and actuation of the motors driving the pumps and rollers 96 and 98 may also be initiated by hand. In the alternative, it is understood that automatic actuating devices as known in the art may be employed if desired. Furthermore, the apparatus may be assembled in such a way that assemblies 16 and 18 and wetting box 90 are movable together while the remaining elements of the system, connected by flexible hose for conduits 84, 49, 46 and 48 can be located on a platform such as a trailer. On the other hand, all of the elements of the apparatus could be assembled and moved together. An important advantage of this invention is that the apparatus can if desired be remotely operated thereby reducing the exposure of the persons involved to any hazards which may exist. It should also be noted that plug 94 is a precursor would not be required if roving 92 or vent tube 93 were not employed.

There are a large number and variety of monomers and additives commercially available having the aforementioned characteristics which can be selected for the application herein described, provided a two or more component system is employed, so that the separate components can be stored indefinitely and then mixed at the point of use, i.e., in assemblies 16 and 18. Many such compositioned systems are known in the art and could be employed to carry out the principles of this invention. The below example describes materials which have been used successfully.

EXAMPLES

The following table lists specific materials which were selected and used successfully in filling several holes six feet in length with an ID of 1⅝ inches at an ambient temperature of about 60°F. Each hole took about 1 min. 25 secs. to fill, with a jelling time after filling of about 3–5 min. before assembly 18 could be moved to the next hole. Coating 63 and gasket 86 were made from Teflon so that there was no adherence during polymerzation either to the outer surface of gasket 86 or to the inner surfaces of well 62, and no leakage between gasket 86 and wall 14. Only sufficient pressure was provided by pumps $P_1$ and $P_2$ to overcome static pressure and fill the length of the holes.

TABLE

| 1. Promoted Resin Mixture | |
|---|---|
| A. Base Mixture | |
| (a) Resin solution | |
| Chlorinated polyester flakes (low flammability) | 30% |
| Polystyrene pellets (expansion agent) | 15% |
| Chlorostyrene monomer (high flash point & low shrinkage) | 38%** |
| (b) Milled glass, 1/32 in. | 17% |
| B. Additives | |
| Dimethylaniline promoter 1/2% of resin solution wt. | |
| cobalt naphthenate promoter 1% of resin solution wt. | |
| hydroquine inhibitor (for long term storage) 100 ppm wt. | |
| fumed silica (thixatropic agent) 1/2% of base mixture wt. | |
| silane - 2% of base mixture wt. | |
| **2. Catalyzed Resin Mixture** | |
| A. Base Mixture (same as above) | |
| B. Additives | |
| fumed silica - 1/2% of base mixture wt. | |
| silane - 2% of base mixture wt: | |
| methyl ethyl ketone peroxide catalyst (fire resistant), 1-1/2% of resin solution wt. | |
| hydroquinine inhibitor, 100 ppm of resin solution wt. | |

TABLE-continued

| 3. Wetting resin |
|---|
| A. Base mixture - chlorinated polyester flakes, 50% and chlorostyrene monomer, 50% |
| B. methyl ethyl ketone peroxide catalyst, 3/4% of base mixture wt. hydroquinine inhibitor, 100 ppm of base mixture wt. silane - 2% of base mixture wt. |
| 4. Purge fluid - 1, 1, 1, - trichloroethane |

*all percentages by weight
**varied ± 5% to adjust viscosity depending on ambient temperature

What is claimed is:

1. Apparatus for providing a rockbolt in an upwardly extending bore hole in a rock face, comprising:

a. first supply means for a pumpable stable first composition which is the first of a two component ambient temperature curable resin system;

b. second supply means for a pumpable stable second composition which is the second of the two component ambient temperature curable resin system;

c. mixing means for receiving the first and second compositions for forming an intimate mixture thereof;

d. means for simultaneously pumping the components from said first and second supply means in preselected proportion to said mixing means; and e. bolting head assembly means for receiving said mixture from said mixing means and communicating with the inlet of said bore hole to deliver said mixture into said hole, said assembly means having a well for communicating with said hole during delivery of said mixture into said hole and during polymerization of said mixture, said well having means to prevent adherence of the polymerized mixture to said assembly means, thereby permitting removal of said assembly means from said rock face.

2. The apparatus of claim 1 having means to purge from said apparatus any mixture of said compositions remaining outside of said well after pumping into said hole is complete.

3. The apparatus of claim 2 having means to supply resilient long stranded material to said hole during pumping to provide additional strength to said rockbolt.

4. The apparatus of claim 1 having means to supply to said hole during pumping a venting tube to release dropped gases in said hole and to remain during polymerization to provide additional strength to said rockbolt.

* * * * *